US008013802B2

(12) United States Patent
Hall et al.

(10) Patent No.: US 8,013,802 B2
(45) Date of Patent: Sep. 6, 2011

(54) PORTABLE RADAR FAIRING

(75) Inventors: Richard R. Hall, Baldwinsville, NY (US); Matthew A. Hutchinson, Syracuse, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 366 days.

(21) Appl. No.: 12/325,567

(22) Filed: Dec. 1, 2008

(65) Prior Publication Data

US 2010/0134379 A1 Jun. 3, 2010

(51) Int. Cl.
*H01Q 1/42* (2006.01)

(52) U.S. Cl. ..... 343/872; 343/713; 52/66

(58) Field of Classification Search ..... 343/841, 343/872, 711, 712, 713; 52/2, 66
See application file for complete search history.

(56) References Cited

U.S. PATENT DOCUMENTS

| | | | | | |
|---|---|---|---|---|---|
| 2,381,350 | A * | 8/1945 | Hall | 244/130 |
| 2,702,346 | A * | 2/1955 | Evans et al. | 343/766 |
| 4,833,837 | A * | 5/1989 | Bonneau | 52/2.19 |
| 5,220,979 | A * | 6/1993 | Matsuda | 187/401 |
| 5,860,715 | A * | 1/1999 | Lohde et al. | 312/287 |
| 5,986,611 | A * | 11/1999 | Harrison et al. | 343/705 |
| 6,278,409 | B1 * | 8/2001 | Zuta | 343/756 |
| 2008/0106482 | A1 * | 5/2008 | Cherrette et al. | 343/872 |

OTHER PUBLICATIONS

International Search report dated Jan. 26, 2010 for related application PCT/US2009/066228.

* cited by examiner

*Primary Examiner* — David G Phan
(74) *Attorney, Agent, or Firm* — Howard IP Law Group, P.C.

(57) ABSTRACT

A portable fairing for a mobile radar array system includes at least partially open housing surrounding the mobile radar array and a curved covering mounted on the housing. The curved covering is adapted to cover the radar array in a closed position. The sides of the housing are curved such that when the curved covering is closed, the housing and the curved covering form a generally curved structure.

16 Claims, 8 Drawing Sheets

PORTABLE RADAR FAIRING

FIELD OF THE INVENTION

The invention relates generally to fairings, and more particularly to portable fairings for mobile radar array systems.

BACKGROUND OF THE INVENTION

Radar array systems, both permanent as well as mobile, generally have tall and planar designs for the array structure. Such radar array designs result in high centers of gravity as well as large surface areas which are exposed to wind. Frequently, mobile radar array systems are deployed on sloped terrain, where large and heavy bases are required for the stability of the radar arrays because of their high centers of gravity and large moment loads resulting from tall and planar designs. Moment loads are amplified significantly in strong, gusty winds. Mobile radar array systems are generally mounted on military vehicles for ease of movement and quick deployment in battlefields. Such military vehicles have to be fitted with heavy supporting mechanisms, for example, leveling outriggers and associated actuators, to support and level the mobile radar array system, especially when deployed on a sloped terrain. For radar accuracy, it is necessary to level the radar array system on side slopes. For example, certain military radar array systems require operation on slopes up to seven degrees (7°).

Radar arrays which are permanently installed use long anchor rods and tie-down cables to stabilize the radar arrays in windy conditions. Such methods, however, may either not be feasible or be too time-consuming and/or manpower intensive for mobile radar arrays, as mobile radar array systems generally require quick emplacement and displacement on the battlefield. Alternative mechanisms for stabilizing radar array systems are desired.

SUMMARY OF THE INVENTION

According to an aspect of the present invention, a fairing for a mobile radar array system includes an at least partially open housing surrounding the mobile radar array and a curved covering mounted on the housing. The curved covering is adapted to cover the radar array in a closed position. The sides of the housing are curved such that when the curved covering is closed, the housing and the curved covering form a generally curved structure.

According to an aspect of the invention, the curved structure formed by the housing and the coverings may be a generally cylindrical structure. According to another aspect of the invention, the curved structure formed by the housing and the coverings may be a generally spherical structure.

Yet another aspect of the invention includes a method of reducing drag forces on a radar array system. The method includes a step of providing at least partially open housing for the radar array, wherein the housing has curved sides. The method also includes a step of providing a curved covering mounted on the housing. The curved covering is adapted to cover the radar array. The curved covering and the housing form a generally curved structure.

An embodiment of the invention includes at least first and second curved coverings which are adapted to align with each other to form a generally curved structure around the radar array.

Another embodiment of the invention includes a generally curved structure around the radar array. The generally curved structure includes a plurality of longitudinal members and a plurality of planar members. Each of the plurality of planar members is disposed between two of the plurality of longitudinal members.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which.

DETAILED DESCRIPTION OF PREFERRED EMBODIMENTS

The invention and its various embodiments can now be better understood by turning to the following detailed description of the exemplary embodiments which are presented as illustrated examples of the invention defined in the claims. It is expressly understood that the invention as defined by the claims may be broader than the illustrated embodiments described below. It is to be understood that the figures and descriptions of the present invention have been simplified to illustrate elements that are relevant for a clear understanding of the present invention, while eliminating, for purposes of clarity, many other elements found in mobile radar systems. However, because such elements are well known in the art, and because they do not facilitate a better understanding of the present invention, a discussion of such elements is not provided herein. The disclosure herein is directed to all such variations and modifications known to those skilled in the art. Although the following description is mainly directed towards a mobile radar array system, the invention is also applicable to a permanently installed radar system.

Figure 1:
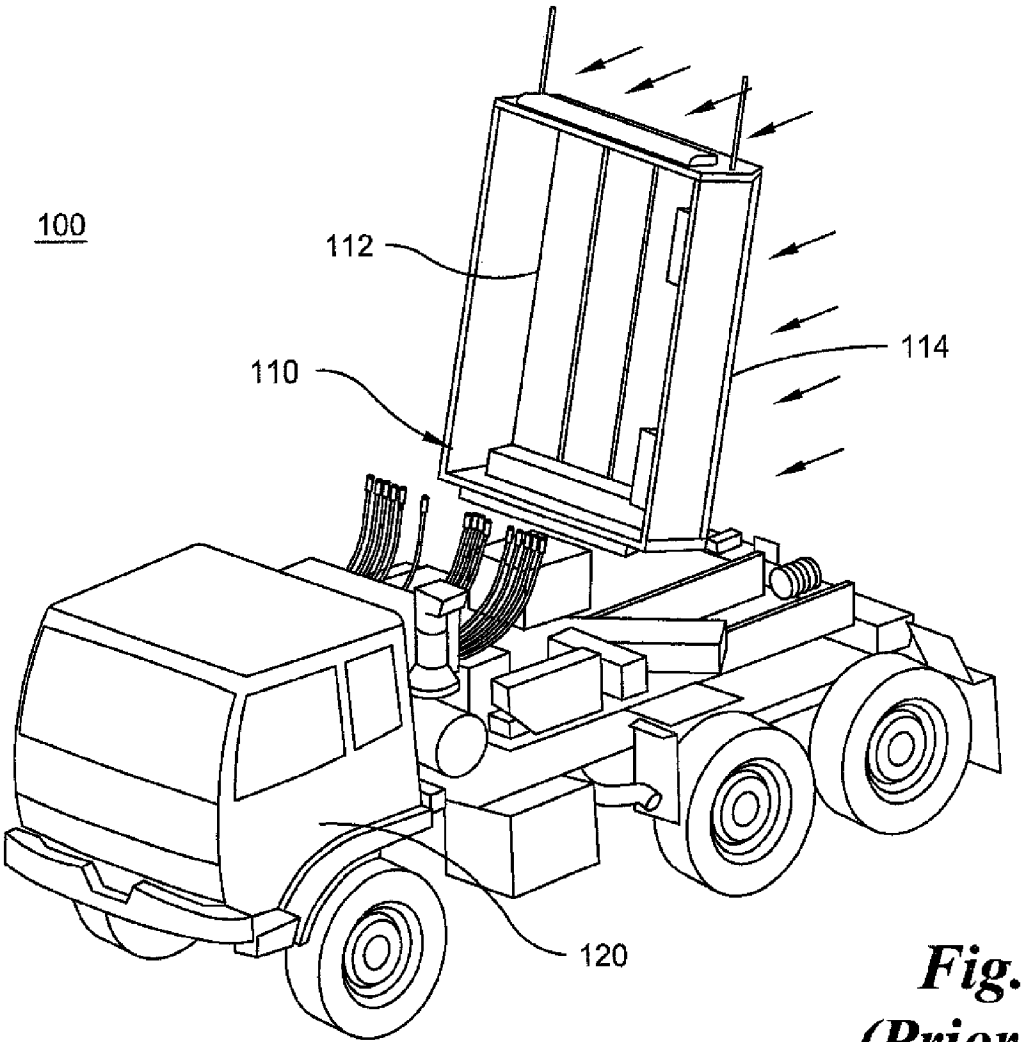
Fig. 1 (Prior Art)
FIG. 1 is a conventional mobile radar array mounted on a military vehicle illustrating force subjected by wind.

Referring initially to FIG. 1, there is shown a conventional mobile radar system which includes a radar array 110 mounted on a vehicle 120. Radar array 110 is generally rectangular and has planar faces 112, 114. Faces 112, 114 are subject to wind forces as shown by the arrows. Radar array 110 is generally housed in a rectangular, box-like structure or housing (not shown). Array 110 also has a high centre of gravity, which coupled with heavy moment loads resulting from wind forces, make the stabilization of array 110 atop vehicle 120 difficult. Furthermore, radar arrays are frequently rotated about a vertical axis at different speeds, for example, at 30 revolutions per minute (RPM) to scan an entire region. At such a speed, array 110 may be subjected to wind forces at a frequency of about 1 hertz (Hz). Depending on the shape and structure of array 110, such wind forces may excite array 110 at or near its resonant frequency, creating further instability in the system.

Figure 2:
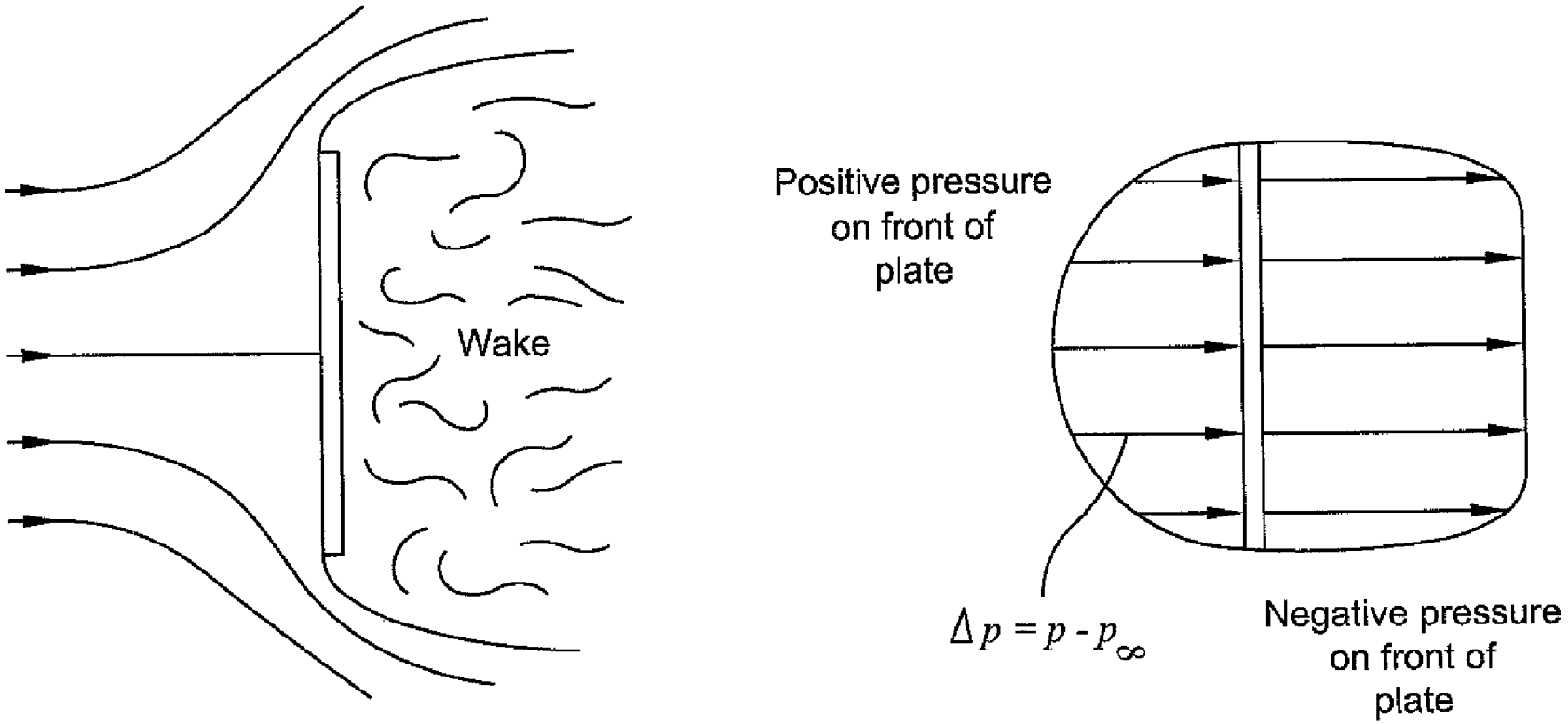
Fig. 2 (Prior Art)
FIG. 2 illustrates forces exerted by wind on a flat surface and resultant creation of drag forces.

Referring now to FIG. 2, there is shown a flow pattern and pressure distribution for a flat surface. As is known in the art, the differential in pressure between the front and rear areas of the surface creates a drag force. This type of drag force creates instability in a conventional mobile radar array system having a generally planar radar array facing the wind forces. As is also known in the art, the drag force may be calculated as follows:

$$F_D=(C_D A\rho v2)/2$$

where, $F_D$ is the drag force;

$C_D$ is the drag coefficient;

A is the frontal area normal to the fluid stream;

ρ is the fluid density; and v is the fluid stream velocity.

Figure 3:
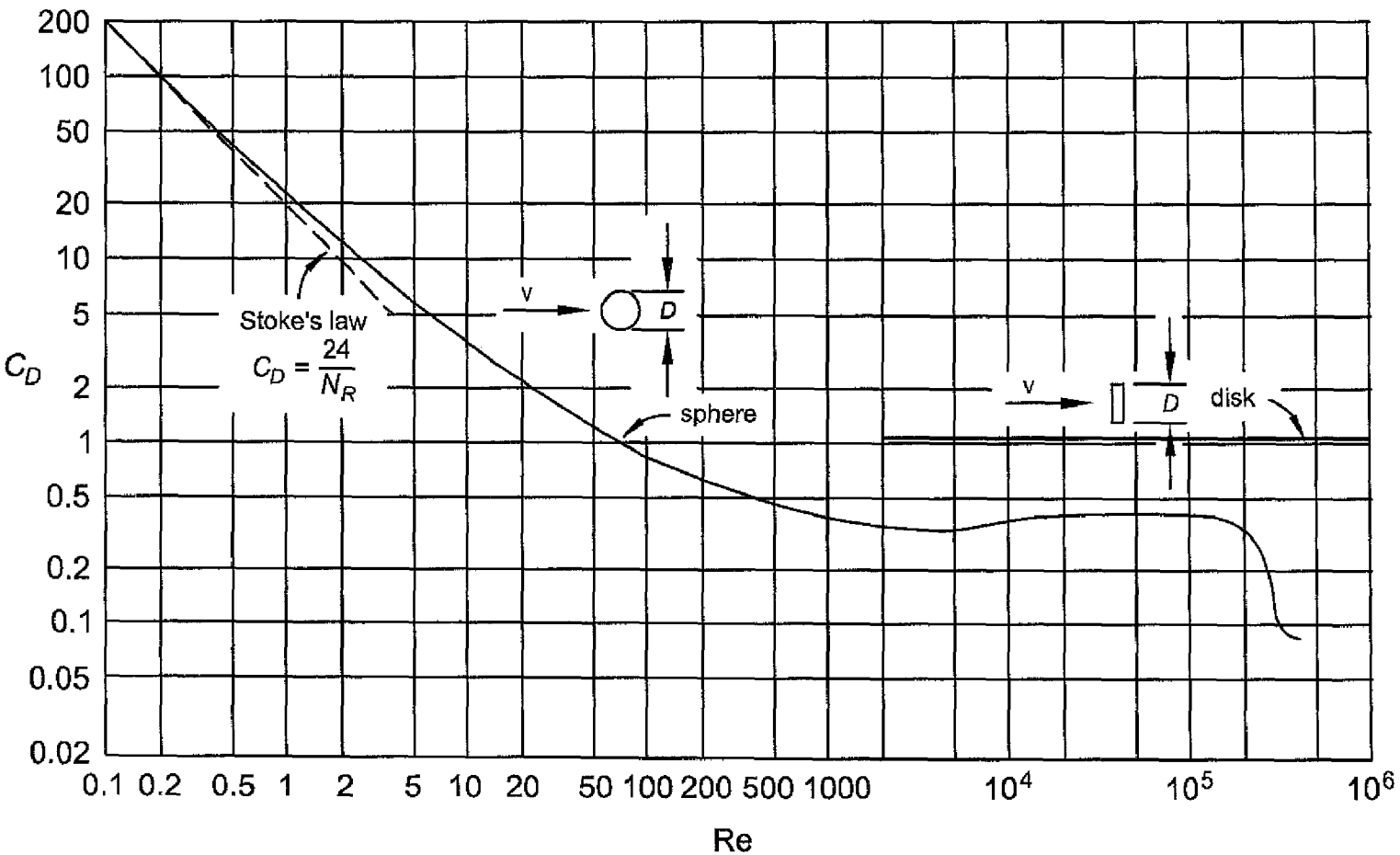
Fig. 3 (Prior Art)
FIG. 3 a graph of drag coefficients versus Reynolds number for a sphere and a circular disc, both having a diameter D.

Of these variables, the draft coefficient, $C_D$, depends on the Reynolds number, the surface roughness, and the level of turbulence in the fluid stream. The drag forces exerted by the wind, for example, may be reduced by lowering the drag coefficient $C_D$. Drag coefficient $C_D$ may be lowered, for example, at higher Reynolds number, by reducing the width of the wake behind radar array 110. One approach for reducing is the drag coefficient, and, therefore, the drag forces, is described below Referring now to FIG. 3, there is illustrated a graph plotting drag coefficient $C_D$ versus Reynolds number for a flow against a sphere and for a flat disc, both having a characteristic diameter D. Drag coefficient $C_D$ essentially remains constant at an approximate value of 1.2 for a flat disc regardless of the value of Reynolds number in the range of 1000 to $10^6$. For a sphere, on other hand, the value of drag coefficient $C_D$ decreases generally proportionally as the value of Reynolds number increases in the range of about 0.1 to about 1000. Drag coefficient $C_D$ remains generally constant at a value of around 0.5 for Reynolds numbers in the range of about 1000 to about $10^5$. For Reynolds number greater than 105, drag coefficient $C_D$ decreases to about 0.1. Thus, drag coefficient $C_D$ may be reduced from about 1.2 to about 0.5 to 0.1 at higher Reynolds number by providing a spherical surface for radar array 110.

Figure 4:
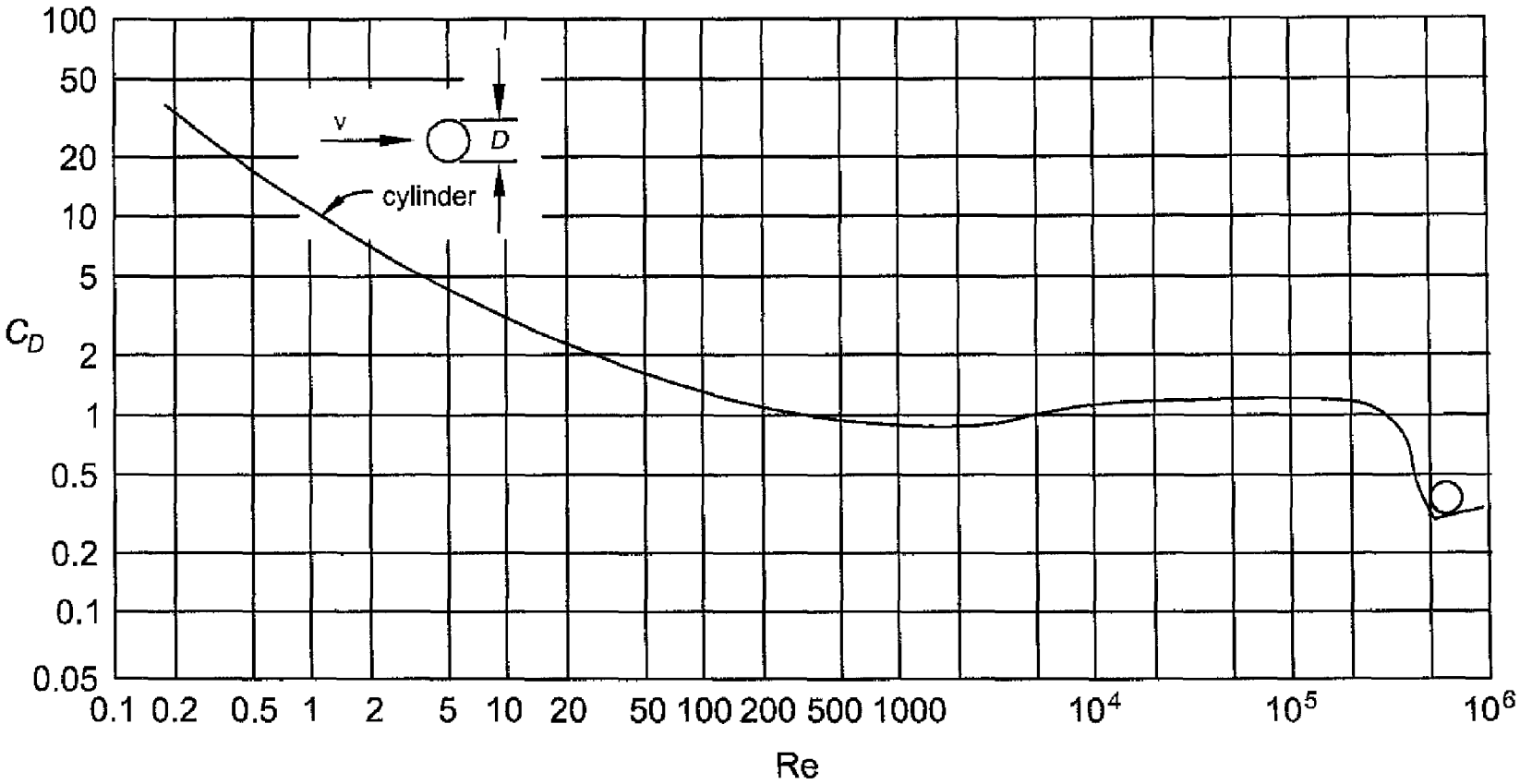
Fig. 4 (Prior Art)
FIG. 4 is a graph of drag coefficient versus Reynolds number for a cylinder having a diameter D.

Referring now to FIG. 4, there is illustrated a graph plotting drag coefficient $C_D$ versus Reynolds number for a flow against a cylinder having a characteristic diameter D. As can be seen from the graph of FIG. 4, although the drag coefficient is higher for a cylinder compared to that for a sphere, at a given Reynolds number, it still is significantly lower than that for a flat disc, all having a characteristic diameter D. Thus, another approach for lowering the drag forces exerted on radar array 110 is to provide a generally cylindrical surface, which will be described in detail below.

Figure 5:
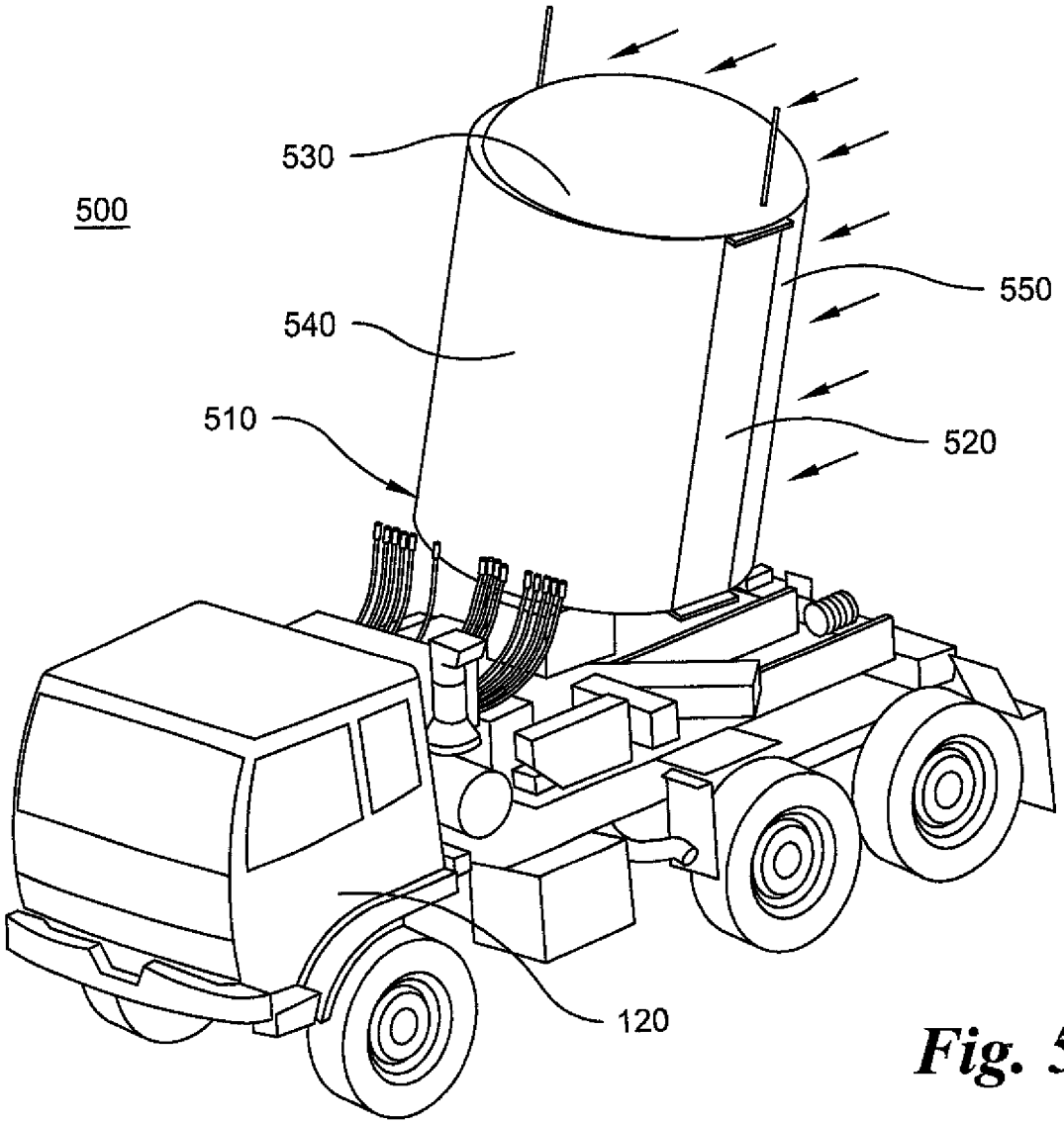
FIG. 5 illustrates an exemplary embodiment of a radar fairing according to an aspect of the invention.

Referring now to FIG. 5, there is shown an exemplary embodiment of a radar fairing 510 on a radar array system 500. In the illustrated embodiment, fairing 510 includes a housing 520 and two coverings 540, 550. Coverings 540, 550 are curved such that, in conjunction with housing 520, fairing 510 forms a generally cylindrical structure, as illustrated. In another embodiment, coverings 540, 550 and housing 520 may also form a generally spherical structure. Fairing 510 further includes a dome 530 fitted atop housing 520 in the illustrated embodiment to further reduce the drag forces. Fairing 510, either in a cylindrical form or a spherical form, would have a diameter generally about the width of the radar array (not shown) being covered. Such a curved fairing 510 provides a greater depth to radar array system 500 in the direction of wind forces resulting in the reduction in the width of the wake behind fairing 510 which results in substantial drop in drag coefficient $C_D$. This reduction in drag coefficient $C_D$ results in a reduction in the drag forces exerted on radar array system 500 in windy conditions.

Coverings 540,550 may either be fixedly or removably connected to housing 520. Removably connected coverings 540, 550 may offer an easy access to the radar array (not shown) covered by fairing 510. Removable coverings 540, 550 may be removed during the transportation of radar array system 500 and may only be mounted on site when the radar array (not shown) is deployed. In another embodiment, coverings 540, 550 may be fixedly connected to housing 520 and may include doors or other such closable openings (not shown) to provide access to the radar array (not shown) when needed. Examples of materials suitable for making coverings 540, 550 and dome 530 include advanced composites made with reinforcements such as fiberglass, graphite, quartz, Kevlar®, cyanate-ester, quartz/cyanate-ester, e-glass/cyanate-ester, and quartz-polybutadiene. Cores (not shown) of coverings 540, 550 and/or dome 530 may be made from, by way of non-limiting examples only, fiberglass, aluminum, graphite honeycombs or polyurethane foams. Coverings 540,550 and/or dome 530 may be coated with membrane made of materials such as polycarbonate, styrene, polyurethane foam, nylon, fiberglass, or Gore-Tex® membranes. Additives may be added to these materials to compensate for signal attenuation at specific radar frequencies. An exemplary additive is ceramic. It would be advantageous if the material selected for coverings 540, 550 is lightweight for ease of transportation while being sufficiently rigid to withstand wind forces. Materials which effectively allow the transmission and reception of radar signals with minimal impedance or attenuation of such signals would be particularly advantageous.

Still referring to FIG. 5, in yet another embodiment, coverings 540, 550 may be inflatable. Such inflatable coverings may be of interest for mobile radar array systems. When the radar array (not shown) is in a stowed position, coverings 540, 550 may be in an uninflated state and which may be conveniently inflated when the radar array (not shown) is in a deployed position. Inflatable coverings 540, 550 may be made from, for example, hypolon-coated Dacron®. Yet another advantage of inflatable or removable coverings is that the coverings need not be inflated or mounted in situations where wind does not adversely affect the stability of radar array system 500. In another embodiment, dome 530 may also be inflatable. Coverings 540, 550 and/or dome 530 may be inflated on site using air pumps, for example. As one of ordinary skill in the art would be familiar with such air pumps, further description of such inflating means is not provided for the sake of brevity. An exemplary vehicle 120 has a central tire inflation (CTI) system with three (3) accumulator tanks on board. The CTI system may assist in the inflation of coverings 540,550 and/or dome 530.

In another embodiment of the present invention, fairing 510 may include only coverings 540, 550. Coverings 540, 550 may be aligned with each to form a generally curved structure without a housing 520. Coverings 540, 550 may be mounted on a frame or track (not shown) associated with the base of the radar array (not shown) thereby dispensing with the need for housing 520. Although the exemplary embodiment includes two coverings 530, 540, other embodiments of the present invention may include more than two coverings, which may all be combined together to form a generally curved structure around the radar array (not shown). In an exemplary embodiment, the generally curved structure may be a generally cylindrical structure. In another embodiment, the generally curved structure may be a generally spherical structure.

Dome 530 may be either fixedly or removably connected to housing 520. The panels of dome 530 may also include Teflon® and/or other hydrophobic coatings for performance in rain. In an exemplary embodiment of the present invention, dome 530 may be removed from housing 520 during transportation of radar array system 500 or when not needed and may be mounted only when the radar array (not shown) is deployed, if needed. In yet another embodiment of the present invention, dome 530 may be formed by coverings 530, 540.

Figure 6:
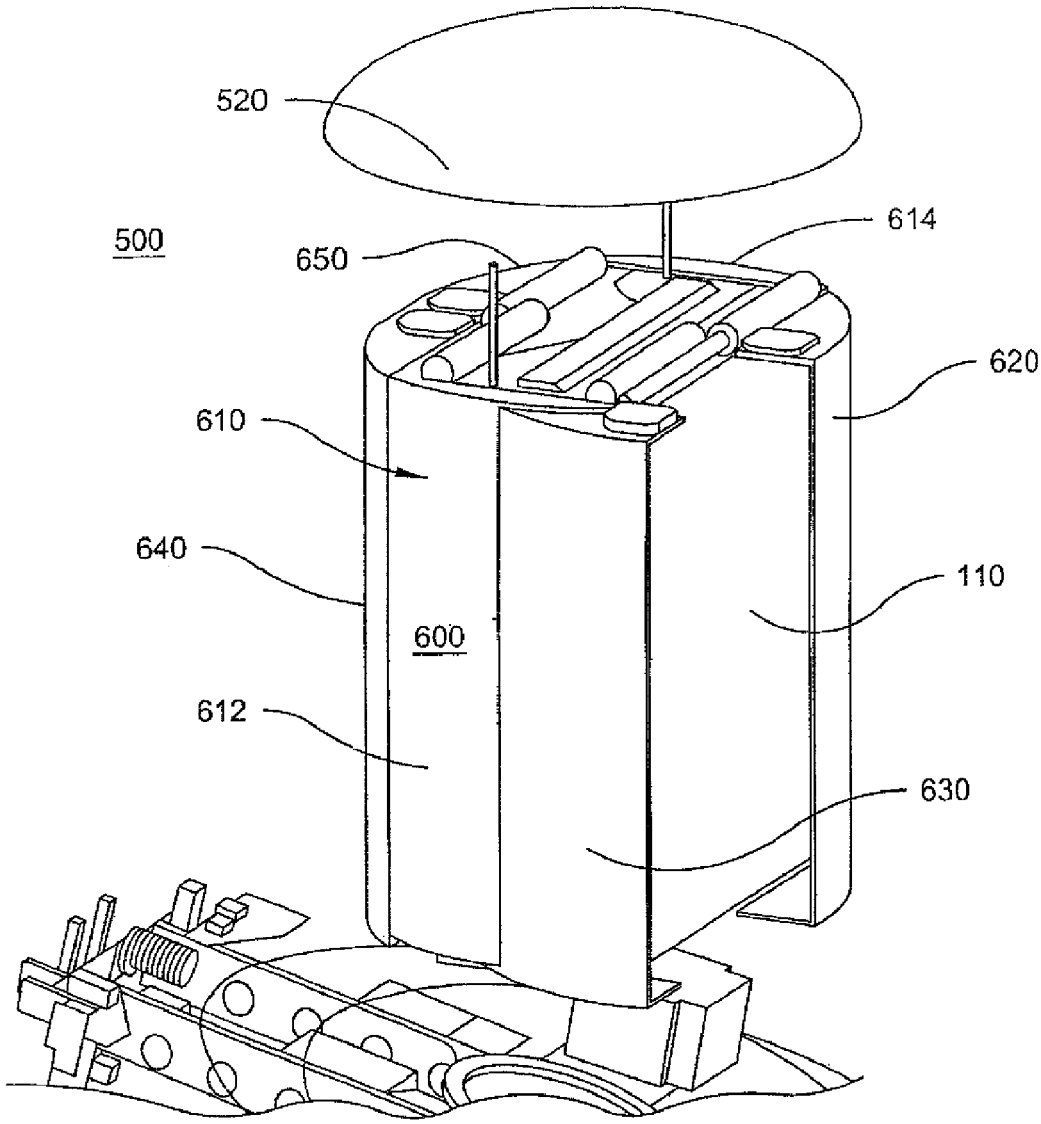
FIG. 6 illustrates the radar fairing of FIG. 5 with two shells open.

Now referring to FIG. 6, radar array 110 is housed in fairing 500. In an exemplary embodiment, fairing 600 includes a curved housing 610 and shells 620, 630, 640, 650. As per an aspect of the invention, housing 610 and shells 620, 630, 640, 650 together define a generally cylindrical structure. In an exemplary embodiment, housing 610 has two generally curved sides 612, 614. In the illustrated embodiment, shells 620, 630, 640, 650 are movably connected or mounted to housing 610. In an exemplary embodiment, the connections between shells 620, 630, 640, 650 and housing 610 are in the form of hinge brackets with pins. In other embodiments, the connections may be in the form of ball or roller bearing guide ways, wheels in tracks, Teflon® sleeves, or other hardware that provides travel of several feet. Such mechanisms are known in the art, and therefore, are not described in further detail for the sake of brevity. Shells 620, 630, 640, 650 are adapted to retract along sides 612, 614 respectively. Shells 620, 630, 640, 650 may be manually retractable and deployable in an exemplary embodiment of the invention. Another embodiment of the present invention may include motors and actuators, for example, to retract and deploy shells 620, 630, 640, 650. Non-limiting examples of such driving mechanisms are linear motors, lead screws with stepping motors, pneumatic cylinders, hydraulic cylinders, chain drives with motors, belt drives with motors, or other drive systems that provide several feet of travel. Since such travel and/or driving mechanisms are known in the art, further details are not provided for the sake of brevity. The driving mechanisms (not shown) may be provided only at the top of housing 610 in an exemplary embodiment. In another embodiment of the present invention, driving mechanisms may be provided at the top as well as the bottom of housing 610.

In an exemplary embodiment, housing 610 and shells 620, 630, 640, 650 may be made of same materials. In another embodiment, housing 610 may be made of a different material, such as a metal, an alloy and/or a composite, which provides additional protection to the radar array (not shown) in a stowed state or during the transportation thereof.

Figure 7A:
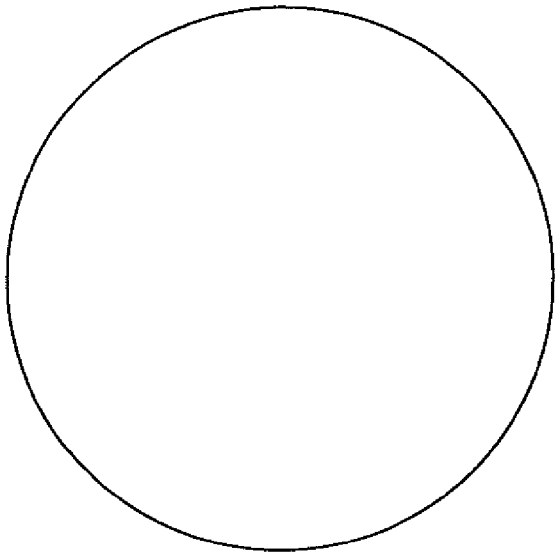
FIGS. 7A-7B illustrate a top schematic view and a front schematic view of another embodiment of the present invention.
Figure 7B:
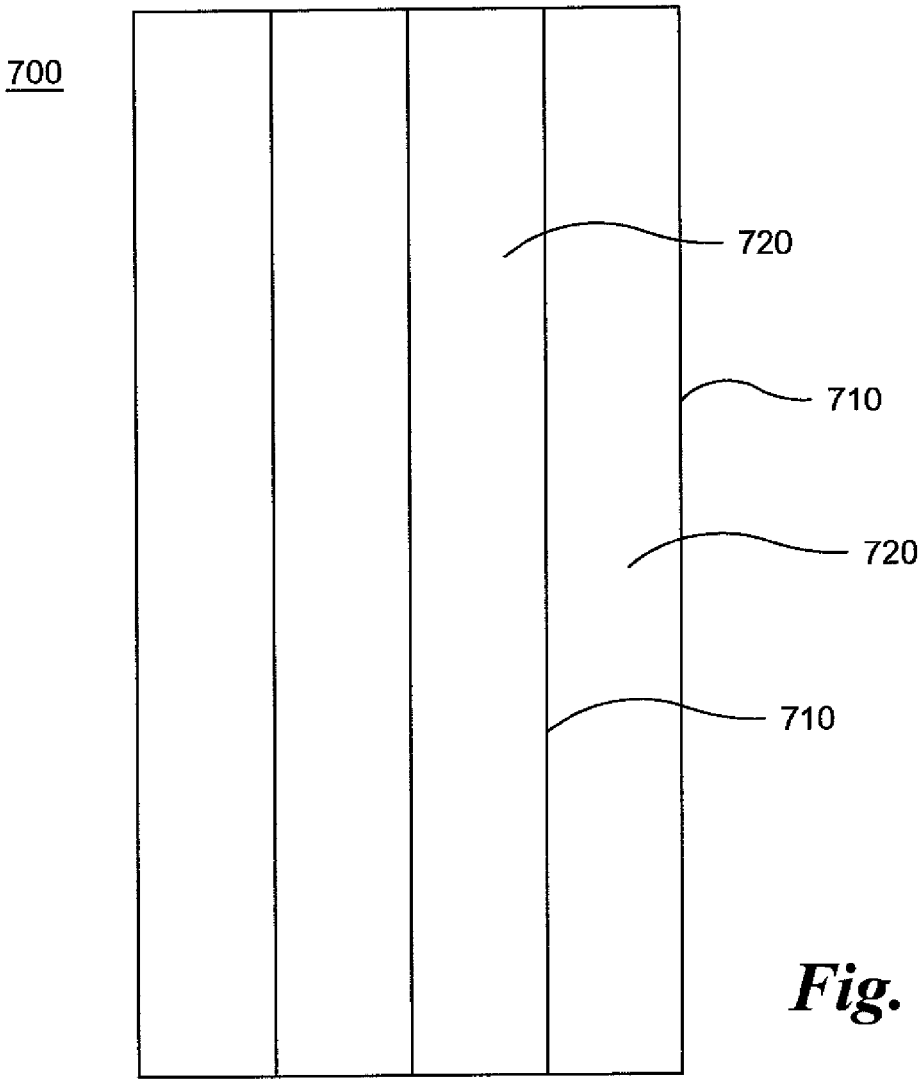

Referring now to FIGS. 7A-7B, there is illustrated another embodiment of a fairing 700. Fairing 700 includes longitudinal members 710 and planar members 720. Each one of the planar members 720 is disposed between two longitudinal members 710. Longitudinal members 710 and planar members 720 together form a generally curved structure around the radar array (not shown). In the illustrated embodiment, the generally curved structure is a generally cylindrical structure. In another embodiment, planar members 720 may be inflatable.

Figure 8:
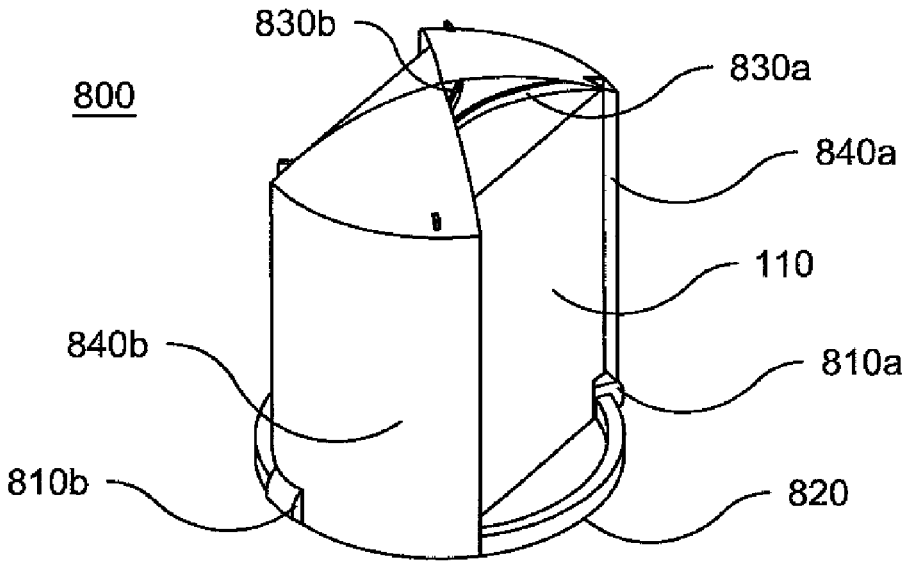
FIG. 8 illustrates radar fairings in a retracted mode, according to an exemplary embodiment of the present invention.

Referring now to FIG. 8, an exemplary embodiment of a fairing 800 is illustrated wherein coverings 840*a*, 840*b* are shown in a retracted state. Coverings 840*a*, 840*b* may be retracted, when, for example, not needed, or when radar 110 is in a transport mode. Coverings 840*a*, 840*b* move along a drive track 820. As is known in the art, a stationary pedestal is mechanical coupled to the frame of a prime mover. A rotating pedestal is then rotatably coupled to the stationary pedestal. A mobile radar array is generally mounted on the rotating pedestal. In an exemplary embodiment, drive track 820 may be fixedly mounted on the rotating pedestal (not shown). In other embodiments, drive track 820 may be removably mounted on the rotating pedestal (not shown). In an exemplary embodiment, guide track 820 is in the form of a generally circular track. In other embodiments, guide track 820 may include a plurality of arcuate segments defining a generally circular track. In an exemplary embodiment, drive track 820 may take the form of a circular rack.

In an exemplary embodiment, a fairing actuator drive 810*b* is coupled to covering 840*b* and drive track 820 and may be operated to move covering 840*b* along drive track 820. Similarly, a fairing actuator drive 810*a* is coupled to covering 840*a* and drive track 820 and may be operated to move covering 840*a* along drive track 820. In an exemplary embodiment, fairing actuator drives 810*a*, 810*b* may include pinions to cooperate with a circular rack drive track 820. In an exemplary embodiment, fairing actuator drives 810*a*, 810*b* may be mechanically uncoupled from coverings 840*a*, 840*b* when coverings 840*a*, 840*b* are retracted along the sides of array 110 for stowing array 100 during a transport mode. Mechanical fasteners such as bolts, rivets, pins, and clamping latches may be used to couple drive actuators 810*a*, 810*b* to coverings 840*a*, 840*b* respectively. These coupling mechanisms are not described in further detail for the sake of brevity.

Fairing 800 further includes support track or guide tracks 830*a*, 830*b*. In the illustrated embodiment, guide tracks 830*a*, 830*b* are shown in a folded state. In an exemplary embodiment, guide tracks 830*a*, 830*b* may be completely disconnected and be stored at the top of array 110, as is illustrated. In another exemplary embodiment, guide tracks 830*a*, 830*b* may be hingedly connected to array 110 and be folded back when not needed. Further details regarding the connections and folding mechanisms for guide tracks 830*a*, 830*b* and driver tracks 820*a*, 820*b* are not provided for the sake of brevity.

Figure 9:
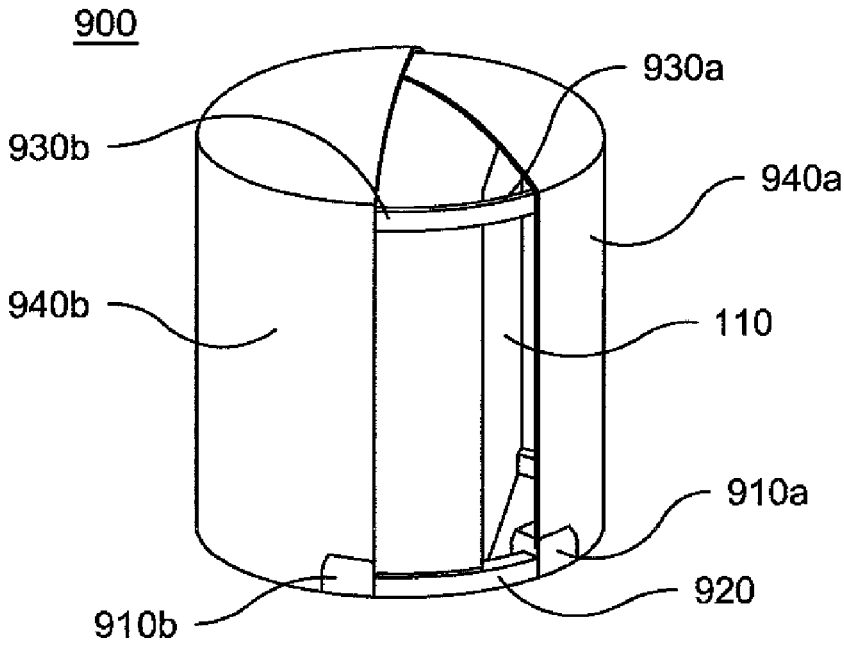
FIG. 9 illustrates radar fairings being deployed to an operational mode, according to an exemplary embodiment of the invention.

FIG. 9 illustrated another exemplary embodiment of a fairing 900. Fairing 900 includes two coverings 940*a*, 940*b*. Covering 940*a* is mounted to, and is movable along, a drive track 920. A fairing actuator drive 910*a* is coupled to covering 940*a* and drive track 920, and may be operated to move covering 940*a* along drive track 920. Similarly, a fairing actuator drive 910*b* is coupled to covering 940*b* and drive track 920 and may be operated to move covering 940*b* along drive track 920. Fairing 900 further includes two guide tracks 930*a*, 930*b*.

In an embodiment of the invention, the generally curved structure housing the radar array may rotate with the radar array. In another embodiment of the invention, the generally curved structure may be independent of the radar array and may not rotate with the radar array.

There are a number of advantages of providing such a portable fairing for a radar array, and particularly for a mobile radar array. By reducing the drag forces experienced by generally tall-standing radar arrays, an increased stability for the mobile radar array is achieved. The reduction in drag forces may allow for deploying larger radar arrays in the field which may result in better transmission and reception of radar signals. An increased versatility may be available in orienting the vehicle carrying the radar array particularly in sloped and/or uneven terrain, where drag forces due to heavy winds may restrict the vehicle orientation to a narrow range. The reduction in drag forces may also eliminate or at least reduce the need for heavy outriggers mounted on the vehicle to stabilize and level the radar array when deployed in a battlefield. A rotating flat radar array may be subjected to full force of wind twice in each revolution. Depending on the wind velocity and rotational speed of the radar array, such a radar array may be excited close to its natural frequency due to wind creating additional instability in the system. A fairing covering the radar array would result in the change of the natural frequency of the structure as well as would eliminate or at least reduce wind-induced excitation significantly by reducing the wind forces on the radar array. Furthermore, if the fairing does not rotate and only the radar array within the fairing rotates, the excitation of the radar array due to the wind is avoided.

Yet another advantage of the present invention is that fairings 510 (of FIG. 5) and 600 (of FIG. 6), for example, are lightweight and portable, and therefore are suitable for deploying on a mobile radar array system. Curved housings 520 (of FIG. 5) and 610 (of FIG. 6) are integral to the mobile array system. Curved housings facilitate in reduction of drag forces. Since one or more coverings may be removably and/or retractably coupled to curved housing, these coverings may be deployed when the mobile radar array is in an operational mode and may be removed and/or retracted when the mobile radar array in a transport mode. Curved housings also advantageously facilitate retraction of the coverings along the housings, thereby enabling the mobile radar array to be folded along the prime mover, without having to remove the coverings.

Although the present invention has been set forth in terms of the exemplary embodiments described herein, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the present invention be interpreted as encompassing all alterations, modifications, or alternative applications as fall within the true spirit and scope of the invention.

What is claimed is:

1. A fairing for a mobile radar array system having a planar radar array mounted on a terrestrial vehicle, said fairing comprising:

an at least partially open housing having:

a first curved side that covers a first side of said planar radar array; and a second curved side that covers a second side of said planar radar array opposite said first side;

a first curved covering mounted on said housing and configured to extend from one of said first and second sides of the housing to the other of said first and second sides of the housing so as to cover a first face of said planar; and a second curved covering mounted on said housing and configured to extend from one of said first and second sides of the housing to the other of said first and second sides of the housing so as to cover a second face of said planar radar array opposite said first face, wherein the first and second curved sides of said housing and said first and second coverings, form a curved structure when said first and second curved coverings are positioned to cover said first and second faces of said planar radar array, respectively.

2. The fairing of claim 1, further comprising a dome positioned on top of said housing, said dome having a peripheral edge configured to mate with the top edges of said first and second coverings and said first and second curved sides of the housing.

3. The fairing of claim 2, wherein said dome is inflatable.

4. The fairing of claim 2, wherein said dome is removably connected to said housing.

5. The fairing of claim 2, wherein said dome is fixedly connected to said housing.

6. The fairing of claim 2, wherein said dome is formed by said first and second coverings.

7. The fairing of claim 1, wherein said curved structure is generally cylindrical.

8. The fairing of claim 1, wherein said curved structure is generally spherical.

9. The fairing of claim 1, wherein, said first curved covering comprises first and second shells, said first shell movably mounted on said first curved side of said housing and said second shell movably mounted on said second curved side of said housing; and said second curved covering comprises third and fourth shells, said third shell movably mounted on said first curved side of said housing and said fourth shell movably mounted on said second curved side of said housing.

10. The fairing of claim 1, wherein said first and second curved coverings are removably mounted to said housing.

11. The fairing of claim 1, wherein said first and second curved coverings are retractably mounted to said housing, each of said first and second coverings being adapted to extend from and retract along one of said first and second curved sides of said housing.

12. The fairing of claim 1, wherein said first and second coverings are inflatable.

13. The fairing of claim 1, wherein said first and second coverings are fixedly mounted to said housing.

14. The fairing of claim 1, further comprising a drive track along which said first and second curved coverings move.

15. The fairing of claim 14, wherein said drive track is configured to be foldable.

16. The fairing of claim 1, further comprising a fairing actuator drive, said fairing actuator drive adapted to move said first and second coverings about said mobile radar array.

* * * * *